US009783925B1

(12) United States Patent
Pollett et al.

(10) Patent No.: US 9,783,925 B1
(45) Date of Patent: Oct. 10, 2017

(54) DRYER APPLIANCES AND METHODS OF OPERATION

(71) Applicant: General Electric Company, Schenectady, NY (US)

(72) Inventors: James Quentin Pollett, Louisville, KY (US); Zhiquan Yu, Mason, OH (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/096,325

(22) Filed: Apr. 12, 2016

(51) Int. Cl.
*D06F 58/28* (2006.01)
*D06F 58/02* (2006.01)

(52) U.S. Cl.
CPC ..... *D06F 58/28* (2013.01); *D06F 58/02* (2013.01); *D06F 2058/2854* (2013.01)

(58) Field of Classification Search
CPC ... D06F 58/28; D06F 58/02; D06F 2058/2858
USPC ..... 34/427, 595
See application file for complete search history.

(56) References Cited

U.S. PATENT DOCUMENTS 3,563,474 A * 2/1971 Robinson ..... B05B 1/02 134/172
4,088,017 A 5/1978 Olges
5,628,122 A * 5/1997 Spinardi ..... D06F 58/22 137/132
5,860,224 A 1/1999 Larson
6,785,981 B1 9/2004 Harpenau
8,087,182 B2 * 1/2012 Steffens ..... D06F 58/206 165/156
8,973,286 B1 * 3/2015 Hyde ..... D06F 58/206 134/104.1
8,997,377 B2 * 4/2015 Kim ..... D06F 58/22 34/610
9,027,256 B2 * 5/2015 Kim ..... F26B 21/003 34/86
9,080,283 B2 * 7/2015 Bellinger ..... D06F 58/28
9,134,068 B2 * 9/2015 Choi ..... D06F 58/28
9,163,352 B2 * 10/2015 Han ..... D06F 58/26
9,200,841 B2 * 12/2015 Heo ..... D06F 58/02
9,243,844 B2 * 1/2016 Yu ..... F26B 21/004
9,249,538 B2 * 2/2016 Bison ..... D06F 58/24
9,359,713 B2 * 6/2016 Kang ..... D06F 25/00
(Continued)

FOREIGN PATENT DOCUMENTS

BE EP 2584086 A1 * 4/2013 ..... D06F 58/22
DE 102007062783 * 7/2009 ..... D06F 58/22
(Continued)

*Primary Examiner* — Stephen M Gravini
(74) *Attorney, Agent, or Firm* — Dority & Manning, P.A.

(57) ABSTRACT

A dryer appliance is provided, including a cabinet, a drum, an outlet assembly, an exhaust sensor, and a fluid injector. The drum may be mounted within the cabinet and define a drying chamber. The outlet assembly may be attached to the drying chamber and include a conduit defining an exhaust passage in fluid communication with the drying chamber. The conduit may extend from an inlet at the drying chamber to an outlet. The conduit may further define an access port along the exhaust passage between the inlet and the outlet. The exhaust sensor may be disposed in communication with the exhaust passage. The fluid injector may be attached to the conduit between the inlet and the outlet, and be directed at the access port.

20 Claims, 8 Drawing Sheets

(56) References Cited

U.S. PATENT DOCUMENTS

| | | | | |
|---|---|---|---|---|
| 9,382,658 | B2 * | 7/2016 | Tarifi | D06F 58/22 |
| 9,435,069 | B2 * | 9/2016 | Contarini | D06F 58/206 |
| 9,518,354 | B2 * | 12/2016 | Kulkarni | D06F 58/28 |
| 9,567,704 | B2 * | 2/2017 | Ros | D06F 58/22 |
| 2007/0124955 | A1 | 6/2007 | Crnkovich | |
| 2009/0165330 | A1 | 7/2009 | Krausch | |
| 2010/0058611 | A1 | 3/2010 | Neumann | |
| 2010/0146809 | A1 * | 6/2010 | Grunert | D06F 58/24 34/443 |
| 2013/0091726 | A1 | 4/2013 | Kim et al. | |
| 2016/0053427 | A1 * | 2/2016 | Noh | D06F 58/28 34/427 |
| 2017/0037563 | A1 * | 2/2017 | Kulkarni | D06F 58/28 |

FOREIGN PATENT DOCUMENTS

| | | | | |
|---|---|---|---|---|
| DE | EP 3026167 | A1 * | 6/2016 | D06F 58/02 |
| EP | 2559805 | A1 | 2/2013 | |
| KR | EP 2581490 | A1 * | 4/2013 | D06F 58/22 |
| SE | WO 2015010731 | A1 * | 1/2015 | D06F 58/22 |
| WO | WO2014038112 | A1 | 3/2014 | |

* cited by examiner

DRYER APPLIANCES AND METHODS OF OPERATION

FIELD OF THE INVENTION

The present subject matter relates generally to dryer appliances and associated methods, and more particularly to systems and methods of cleaning portions of a dryer appliance exhaust.

BACKGROUND OF THE INVENTION

Dryer appliances generally include a cabinet with a drum mounted therein. In many dryer appliances, a motor rotates the drum during operation of the dryer appliance, e.g., to tumble articles located within a chamber defined by the drum. Alternatively, dryer appliances with fixed drums have been utilized. Dryer appliances also generally include a heater assembly that passes heated air through the chamber of the drum in order to dry moisture-laden articles disposed within the chamber. This internal air then passes from the chamber through a vent duct to an exhaust conduit, through which the air is exhausted from the dryer appliance. Typically, a blower (also known as an air handler) is utilized to flow the internal air from the vent duct to the exhaust duct. When operating, the blower may pull air through itself from the vent duct, and this air may then flow from the blower to the exhaust conduit.

Although dryer appliances often include filter systems to prevent foreign materials, e.g., lint, from passing into the exhaust conduit, it is difficult for such systems to prevent all foreign materials from entering the exhaust. If left within the exhaust conduit, such foreign materials may impair dryer performance. For instance, accumulated lint may restrict the effective operating size of the passages through which air flows during operation. Restrictions can prevent proper airflow, thereby hindering drying of articles in the dryer appliances. Moreover, the presence of foreign materials on or near an exhaust sensor may reduce sensor accuracy and inhibit the appliance and/or user's ability to monitor certain characteristic of the appliance's operation.

In many existing systems, once foreign materials have accumulated within the exhaust, removal may be difficult and/or time consuming. Use of the dryer appliance must generally be halted as one more utensil is inserted into the exhaust conduit. Foreign materials often must be laboriously vacuumed or scraped out of the exhaust. Some foreign materials, including those around small or difficult to reach portions of the exhaust may even require a portion of the dryer appliance to be disassembled.

Accordingly, improved dryer appliances and methods for cleaning portions of dryer appliances are desired. In particular, dryer appliances and methods that allow for the easy and effective removal of foreign materials.

BRIEF DESCRIPTION OF THE INVENTION

Aspects and advantages of the invention will be set forth in part in the following description, or may be obvious from the description, or may be learned through practice of the invention.

In one aspect of the present disclosure, a dryer appliance is provided, including a cabinet, a drum, an outlet assembly, an exhaust sensor, and a fluid injector. The drum may be mounted within the cabinet and define a drying chamber. The outlet assembly may be attached to the drying chamber and include a conduit defining an exhaust passage in fluid communication with the drying chamber. The conduit may extend from an inlet at the drying chamber to an outlet. The conduit may further define an access port along the exhaust passage between the inlet and the outlet. The exhaust sensor may be disposed in communication with the exhaust passage. The fluid injector may be attached to the conduit between the inlet and the outlet, and be directed at the access port.

In another aspect of the present disclosure, a dryer appliance is provided, including a cabinet, a drum, an outlet assembly, an air handler, and a fluid injector. The drum may be mounted within the cabinet and define a drying chamber. The outlet assembly may be attached to the drying chamber and include a conduit defining an exhaust passage in fluid communication with the drying chamber. The conduit may extend from an inlet at the drying chamber to an outlet. The air handler may be attached to the conduit in fluid communication with the drying chamber. The air handler may include a rotatable impeller operable to draw air through the exhaust passage. The fluid injector may be attached to the air handler and directed at the rotatable impeller.

In yet another aspect of the present disclosure, a method of cleaning an exhaust passage in a dryer appliance is provided. The dryer appliance may include a drying chamber and an exhaust sensor in fluid communication with the exhaust passage. The exhaust passage may be defined by a conduit extending from an inlet at the drying chamber to an outlet. The conduit may further define an access port along the exhaust passage between the inlet and the outlet. The method may include flowing internal air from the drying chamber, determining a cleaning condition within the exhaust passage at the access port, and selectively initiating injection of a fluid toward the access port and into the exhaust passage in response to determining the cleaning condition.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
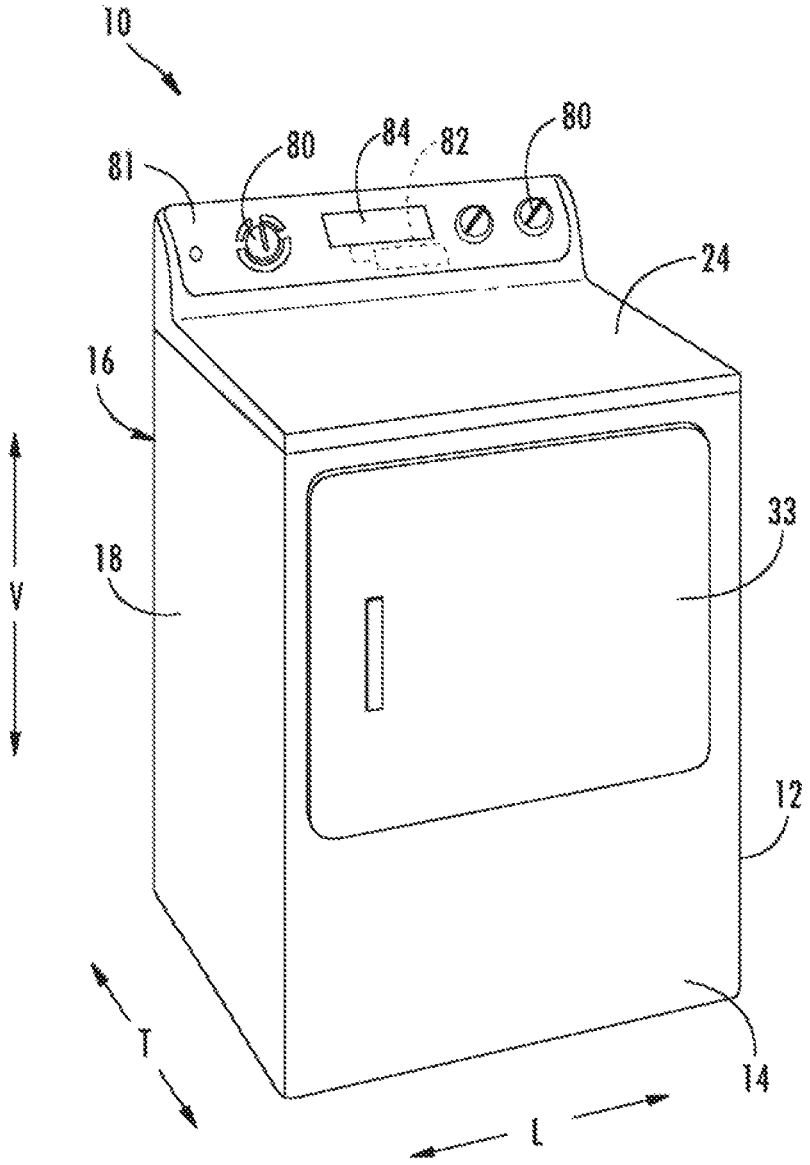
FIG. 1 provides a perspective view of a dryer appliance in accordance with an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In some aspects of the present disclosure, a fluid injector is provided to inject or supply a liquid or gas fluid into an exhaust passage of a dryer appliance. Injection of the fluid may clear accumulated lint or another foreign material from the exhaust passage. A component of the appliance may additionally determine when injection of the fluid may be useful, for example, when a portion of the exhaust has been blocked.

Figure 2:
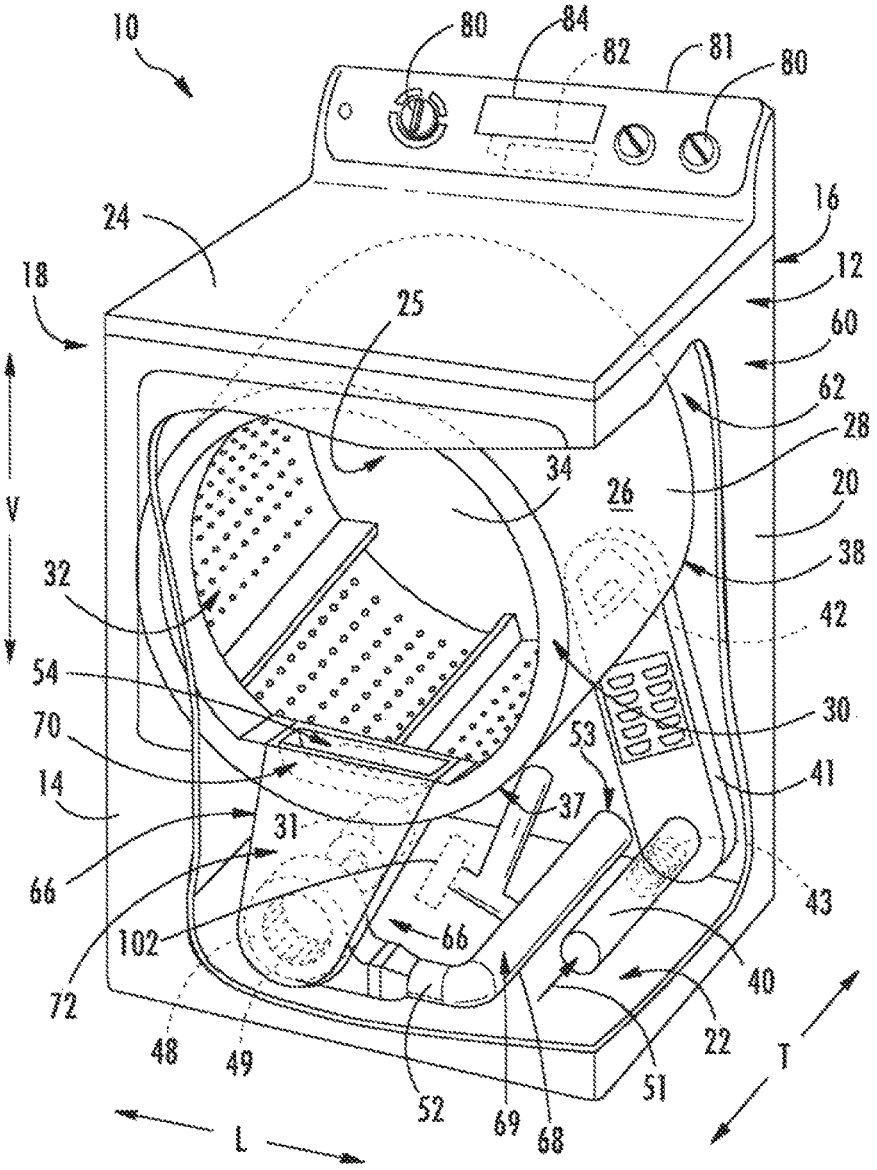
FIG. 2 provides a perspective view of an exemplary dryer appliance embodiment with portions of a cabinet of the dryer appliance removed to reveal certain components of the dryer appliance.
Figure 3:
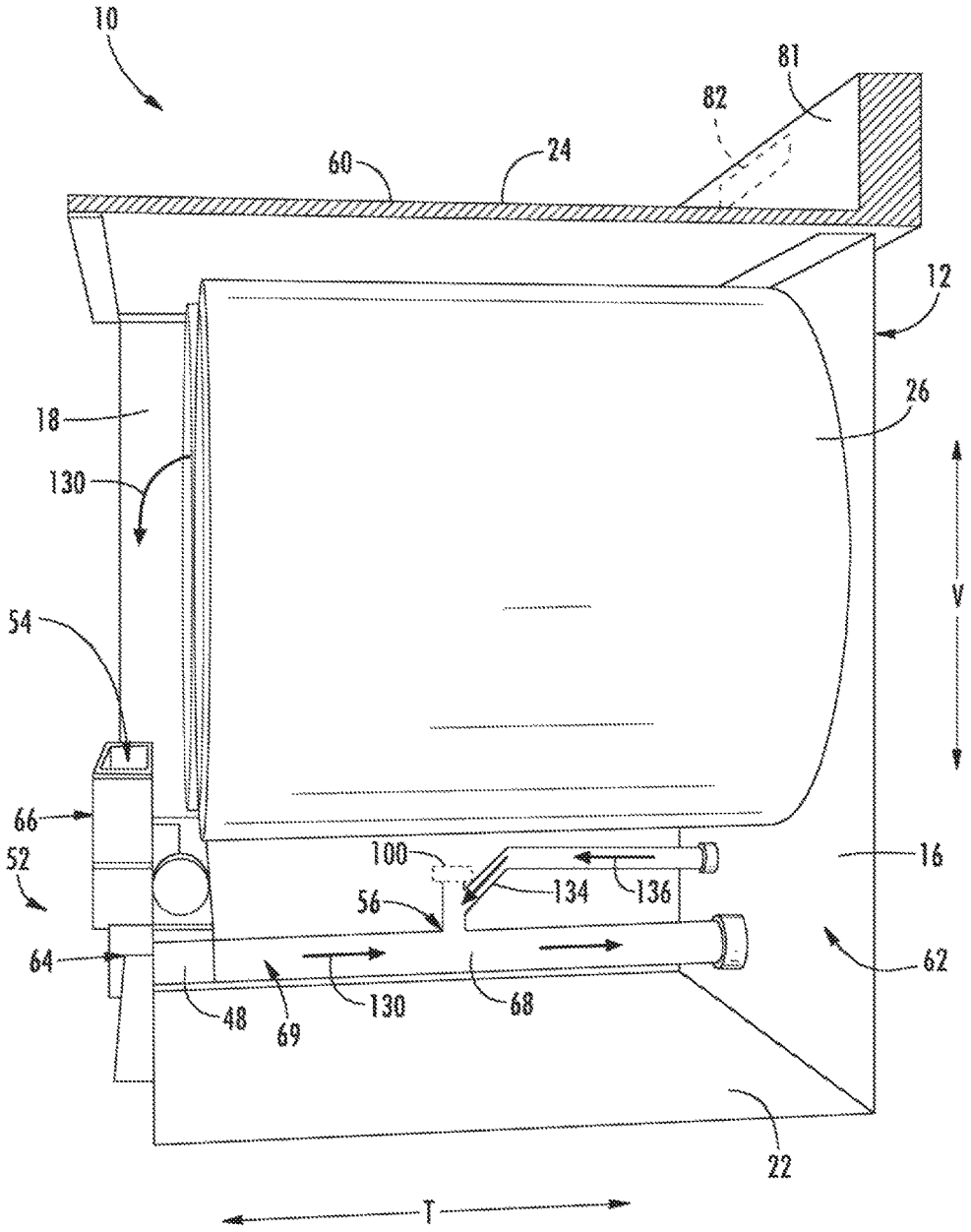
FIG. 3 provides a side schematic view of various components of a dryer appliance in accordance with the exemplary embodiment of FIG. 2.

FIG. 1 illustrates a dryer appliance 10 according to an exemplary embodiment of the present subject matter. FIG. 2 provides another perspective view of dryer appliance 10 with a portion of a cabinet or housing 12 of dryer appliance 10 removed in order to show certain components of dryer appliance 10. FIG. 3 provides a side schematic view of dryer appliance 10. While described in the context of a specific embodiment of dryer appliance 10, using the teachings disclosed herein it will be understood that dryer appliance 10 is provided by way of example only. Other dryer appliances 10 having different appearances and different features may also be utilized with the present subject matter as well. For example, although the embodiments of FIGS. 2 and 3 are configured as an open loop system, which directs exhaust air outside of the dryer appliance, other embodiments may be provided as a closed loop system (See e.g., FIG. 9), a washer/dryer appliance, or as another suitable dryer appliance configuration.

Generally, dryer appliance 10 defines a vertical direction V, a lateral direction L, and a transverse direction T. The vertical direction V, lateral direction L, and transverse direction T are mutually perpendicular and form and orthogonal direction system. Cabinet 12 includes a front panel 14, a rear panel 16, a pair of side panels 18 and 20 spaced apart from each other by front and rear panels 14 and 16, a bottom panel 22, and a top cover 24. These panels and cover collectively define an external surface 60 of cabinet 12 and an interior 62 of cabinet 12. Within interior 62 of cabinet 12 is a drum or container 26. Drum 26 defines a chamber 25 for receipt of articles, e.g., clothing, linen, etc., for drying. Drum 26 extends between a front portion 37 and a back portion 38, e.g., along the transverse direction T. In exemplary embodiments, drum 26 is rotatable, e.g., about an axis that is parallel to the transverse direction T, within cabinet 12. Alternatively, however, the drum 26 may be fixedly mounted within the interior 62.

Drum 26 is generally cylindrical in shape, having an outer cylindrical wall or cylinder 28 and a front flange or wall 30 that may define an entry 32 of drum 26, e.g., at front portion 37 of drum 26, for loading and unloading of articles into and out of chamber 25 of drum 26. Drum 26 also includes a back or rear wall 34, e.g., at a back portion 38 of drum 26. Rear wall 34 of drum 26 may be fixed relative to cabinet 12, e.g., such that cylinder 28 of drum 26 rotates on rear wall 34 of drum 26 during operation of dryer appliance 10.

A motor 31 may be in mechanical communication with a blower 48 such that motor 31 rotates a blower fan or impeller 49 of blower 48. Blower 48 is configured for drawing air through chamber 25 of drum 26, e.g., in order to dry articles located therein, as discussed in greater detail below. In alternative exemplary embodiments, dryer appliance 10 may include an additional motor (not shown) for rotating fan or impeller 49 of blower 48 independently of drum 26.

Drum 26 may be configured to receive heated air that has been heated by a heating assembly 40, e.g., in order to dry damp articles disposed within chamber 25 of drum 26. Heating assembly 40 includes a heater 43, such as a gas burner or an electrical resistance heating element, for heating air. As discussed above, during operation of dryer appliance 10, motor 31 rotates impeller 49 of blower 48 such that blower 48 draws air through chamber 25 of drum 26. In particular, ambient air enters heating assembly 40 via an entrance 51 due to blower 48 urging such ambient air into entrance 51. Such ambient air is heated within heating assembly 40 and exits heating assembly 40 as heated air. Blower 48 draws such heated air through inlet duct 41 to drum 26. The heated air enters drum 26 through an outlet 42 of duct 41. Outlet 42 may be positioned at rear wall 34 of drum 26.

Within chamber 25, the heated air can remove moisture, e.g., from damp articles disposed within chamber 25. This internal air, in turn, flows from chamber 25 through an outlet assembly 64 positioned within interior 62. Generally, outlet assembly 64 includes an exhaust conduit 52 that defines an exhaust passage 69. Exhaust passage 69 is in fluid communication with the drying chamber 25 and extends from an inlet 54 at drying chamber 25 to an outlet 53 defined by cabinet 12. In some embodiments, the exhaust conduit 52 includes a vent duct 66, blower 48, and a ducted conduit 68. As shown, exhaust conduit 52 may be configured in fluid communication with vent duct 66 via blower 48. During a dry cycle, internal air, e.g., airflow at 130, flows from chamber 25 through vent duct 66 to blower 48 and through blower 48 to exhaust conduit 52. The internal air is exhausted from dryer appliance 10 via the outlet 53.

In exemplary embodiments, vent duct 66 may include a filter portion 70 and an exhaust portion 72. Exhaust portion 72 may be positioned downstream of filter portion 70 (in the direction of flow of the internal air). A screen filter of filter portion 70 (which may be removable) traps lint and other foreign materials as the internal air flows therethrough. The internal air may then flow through exhaust portion 72 and blower 48 to ducted conduit 68. After the clothing articles have been dried, the clothing articles are removed from drum 26 via entry 32. A door 33 provides for closing or accessing drum 26 through entry 32.

One or more selector inputs 80, such as knobs, buttons, touchscreen interfaces, etc., may be provided on a cabinet backsplash 81 and in communication with a processing device or controller 82. Signals generated in controller 82 operate a fluid injector 134, as well as motor 31 and heating assembly 40 (including heater 43) in response to the position of selector inputs 80. Additionally, a display 84, such as an indicator light or a screen, may be provided on cabinet backsplash 81. Display 84 may be in communication with controller 82, and may display information in response to signals from controller 82. As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements such as e.g., electrically erasable, programmable read only memory (EEPROM). The memory elements can store information accessible processing device, including instructions that can be executed by processing device. For example, the instructions can be software or any set of instructions that when executed by the processing device, cause the processing device to perform operations. For certain embodiments, the instructions include a software package configured to operate appliance 10 and, e.g., execute the exemplary method 200 described below with reference to FIG. 8.

In some embodiments, dryer appliance 10 may additionally include one or more sensors. For example, exemplary dryer appliance 10 embodiments include one or more exhaust sensors 100 disposed in communication with exhaust passage 69. Exhaust sensor(s) 100 may be attached to and communicate with one or more respective access port(s) 56 defined through a sidewall of ducted conduit 68. Exhaust sensor 100 may be configured as, e.g., a pressure sensor, temperature sensor, or humidity sensor. For instance, exhaust sensor 100 may include an electronic pressure sensor that is configured to detect pressure according to changes in voltage, resistance, voltage, capacitance, or another suitable characteristic associated with changes in pressure. Furthermore, exhaust sensor 100 may be in electrical communication with controller 82, and may selectively transmit readings to controller 82 as required or desired.

Figure 9:
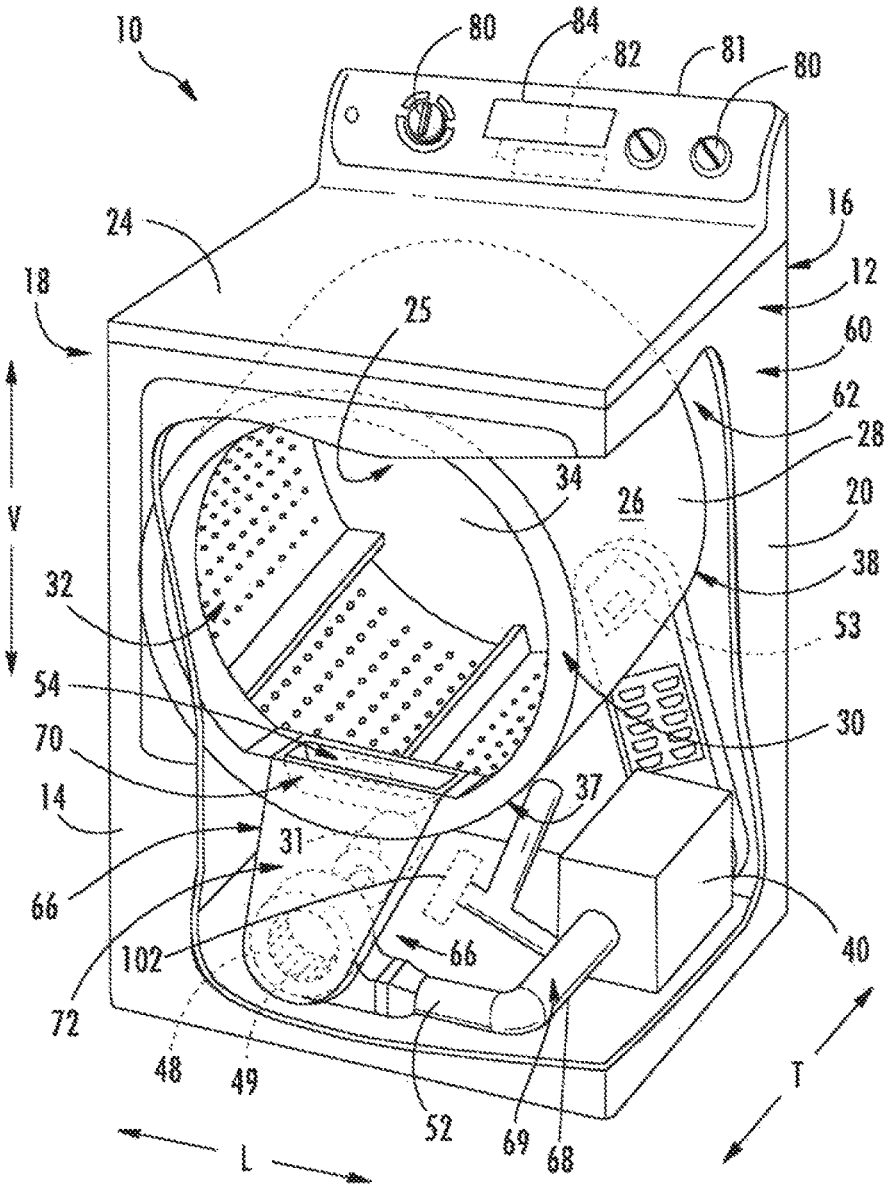
FIG. 9 provides a perspective view of another exemplary dryer appliance embodiment with portions of a cabinet of the dryer appliance removed to reveal certain components of in accordance with another exemplary embodiment of the present disclosure.

As noted above, although an open loop system is illustrated in the embodiment of FIG. 2, alternative embodiments may provide a closed loop system, such as the exemplary embodiment illustrated in FIG. 9. It is understood that the embodiment of FIG. 9 is largely identical to that of FIG. 2, except as otherwise indicated. For instance, the exhaust conduit 52 of FIG. 9 is provided as a closed fluid loop with drum 26. During operation of dryer appliance 10, motor 31 rotates impeller 49 of blower 48 such that blower 48 draws air through chamber 25 of drum 26. Air enters drum 26 via exhaust outlet 53 due to blower 48 cycling air through appliance 10. Air is returned to inlet 54 before passing through exhaust conduit 52 and heating assembly 40 provided as, e.g., a heat pump or refrigerant based heating system. In such embodiments, outlet 53 may be positioned at rear wall 34 of drum 26.

Referring now to FIGS. 2 through 5 and 9, exemplary dryer appliance 10 embodiments include various components for advantageously monitoring for and diagnosing conditions within exhaust passage 69 during operation of the dryer appliance 10. Such components, which may include exhaust sensor(s) 100 (e.g., a pressure sensor, a humidity sensor, a temperature sensor, and/or another suitable sensor component) may advantageously be relatively inexpensive to install and may provide relatively accurate restriction diagnosis. Exhaust sensor(s) 100 may be disposed in communication with exhaust passage 69. In some such embodiments, exhaust sensor 100 is configured as a pressure sensor to monitor pressure levels within dryer appliance 10 during operation. Accordingly, readings or signals from the pressure sensor may indicate the potential existence of a restriction at exhaust passage 69, e.g., in the access port 56. For example, in some embodiments, when readings or signals of the pressure sensor are detected as being below a predefined threshold level or range, controller 82 may determine a foreign material is restricting a portion of exhaust passage 69. In additional or alternative embodiments, controller 82 may determine a foreign material is restricting a portion of exhaust passage 69 when reading or signals of the pressure sensor are detected as being above a predefined threshold level or range. Moreover, a cleaning operation may be selectively initiated to address the restriction.

In exemplary embodiments, controller 82 is configured to determine one or more cleaning conditions within exhaust passage 69. When such a determination is made, controller 82 may initiate the injection of fluid (i.e., fluid flow 136) through access port 56. The cleaning condition may, generally, be embodied as a condition or event when accumulation of a foreign material within exhaust passage 69 has occurred or is likely to occur. In some embodiments, the determination may include detecting a dryer cycle. Controller 82 may receive a signal indicating a general or specific dryer cycle has been selected, e.g., from the selector input(s) 80. Controller 82 may then initiate injection of the fluid in response to detection of the dryer cycle.

In certain embodiments, controller 82 may be configured to determine a cleaning condition upon detecting a predetermined number of dryer cycles. In certain other embodiments, controller 82 may be configured to determine a cleaning condition according to time elapsed. For instance, upon initially detecting initiation or completion of a dryer cycle and determining a predetermined time period has expired subsequent to the initial detection of the dryer cycle.

In additional or alternative embodiments, controller 82 may be configured to determine a cleaning condition at least partially based upon a sensor reading received from exhaust sensor 100. The sensor reading may be a contemporary sensor reading indicative of current conditions being monitored at exhaust sensor 100. Controller 82 may further be configured to compare the contemporary sensor reading to an expected reading value or value range. Generally, the expected value or value range may be selected as a predetermined value, identified from a look-up table, and/or calculated as a dynamic value using a provided equation or algorithm. In some embodiments, a calculated value may be generated by controller 82 according to a median or mean of historical sensor reading data from exhaust sensor 100. If an abnormal or unexpected contemporary sensor reading is received by controller 82, controller 82 may initiate injection of the fluid, e.g., a fluid flow 136. For example, in response to receiving one or more contemporary sensor readings that are greater than or less than the expected value or value range, controller 82 may be configured to initiate injection of the fluid.

As shown, in exemplary embodiments, exhaust sensor 100 is disposed along a ducted conduit 68. A sensor tube 104 may extend from an outer wall of ducted conduit 68 to define a secondary passage 106 extending from exhaust passage 69. As a result, secondary passage 106 may be defined through exhaust conduit 52 as an inlet/outlet between sensor tube 104 and exhaust conduit 52. In some such embodiments, exhaust sensor 100 extends at least partially into sensor tube 104 to evaluate pressure and/or exhaust air directed to sensor tube 104. In additional or alternative embodiments, exhaust sensor 100 and/or sensor tube 104 may be disposed at another portion of exhaust passage 69, such as in vent duct 66, or in another other suitable location within dryer appliance 10. Optionally, multiple exhaust sensors 100 may be provided at discrete locations along exhaust passage 69.

As illustrated, some embodiments of appliance 10 include a fluid injector 134 disposed along exhaust passage 69. In exemplary embodiments, fluid injector 134 is attached to ducted conduit 68 between inlet 54 and outlet 53. Specifically, fluid injector 134 is directed at a portion of exhaust passage 69, e.g., access port 56 of ducted conduit 68. Fluid supplied through fluid injector 134 may dislodge or prevent the buildup of foreign materials that might collect on the exhaust passage 69. In some embodiments, fluid injector 134 extends directly from sensor tube 104 upstream from conduit 68. As a result, fluid injector 134 is in sequential fluid communication with sensor tube 104, access port 56, and exhaust passage 69. During operation of appliance 10, fluid flow 136 may be selectively directed through fluid injector 134 to exhaust passage 69. In certain embodiments, fluid flow 136 passes through an injector aperture 138 defined within a side of sensor tube 104 before being directed through sensor tube 104 and at access port 56. Fluid directed at access port 56 may, in turn, be directed through access port 56 and force foreign materials, e.g., lint, away from access port 56 and downstream through exhaust passage 69.

Fluid provided through fluid injector 134 may be provided as a suitable motivating medium. A suitable liquid (e.g., water) or gas (e.g., air) is provided in optional embodiments. As a result, fluid flow 136 of such embodiments is configured as a liquid flow or secondary airflow, respectively. In embodiments wherein a liquid flow is provided, fluid injector 134 may be configured in fluid communication with a water source (not pictured), e.g., a municipal water supply or a local water tank enclosed within or associated with appliance 10. Liquid, such as water, may be selectively released or flowed through access port 56 and into exhaust passage 68. In embodiments wherein a secondary airflow is provided, fluid injector 134 may be configured in fluid communication with an air source (not pictured), e.g., a pressurized air tank or an ambient environment. In turn, secondary air may be selectively forced or flowed through access port 56 and into exhaust passage. A valve and/or secondary fan or pump (not pictured) may be provided upstream of fluid injector 134 to selectively release and/or force fluid flow 136 from fluid injector 134. Such a valve and/or secondary fan or pump may be in, e.g., electrical communication with controller 82 to receive an injection signal therefrom.

Figure 4:
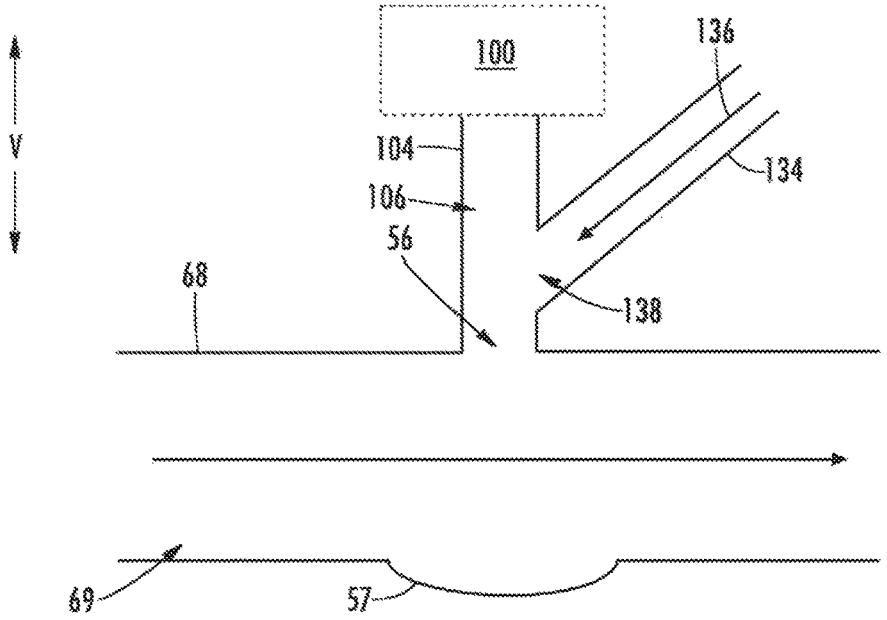
FIG. 4 provides an enlarged side schematic view of a portion of a dryer appliance in accordance with an exemplary embodiment of the present disclosure.
Figure 5:
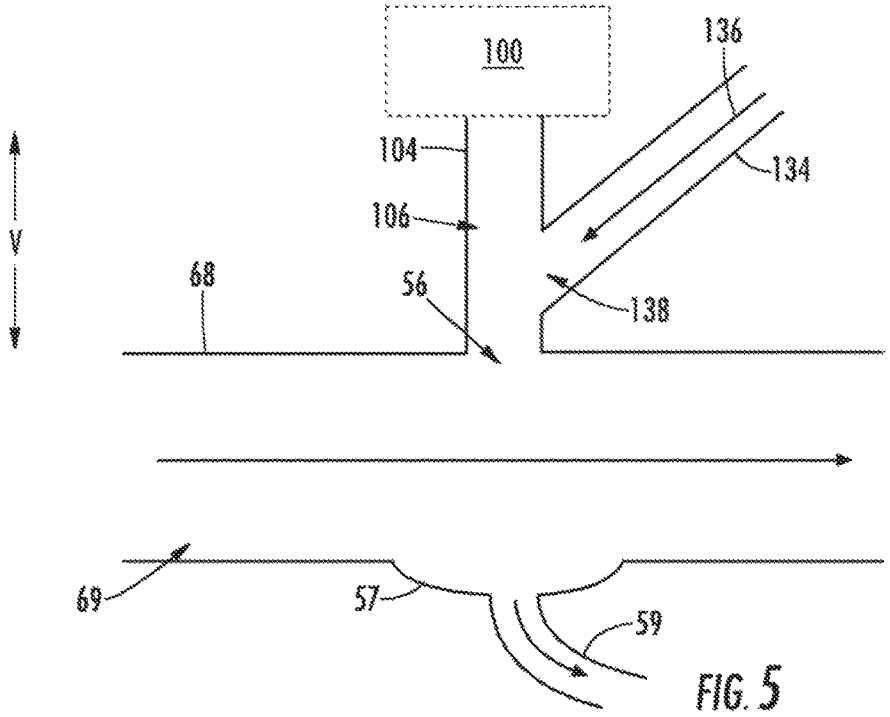
FIG. 5 provides an enlarged side schematic view of various components of a dryer appliance in accordance with another exemplary embodiment of the present disclosure.

As shown in FIGS. 4 and 5, some embodiments of exhaust conduit 52 define a collection basin 57 within the exhaust passage 69, e.g., at ducted conduit 68. Specifically, collection basin 57 is positioned or defined below fluid injector 134 along the vertical direction V downstream from access port 56 (e.g., downstream relative to the exhaust airflow 130 within exhaust passage 69, and/or downstream relative to the fluid flow 136 supplied from fluid injector 134). Collection basin 57 of exemplary embodiments defines a generally concave shape relative to exhaust passage 69. As a result, collection basin 57 is recessed, extending away from exhaust passage 69 at an internal face 58 of ducted conduit 68. Optionally, collection basin 57 may be defined to align directly below access port 56. In turn, both collection basin 57 and access port 56 will be defined coaxially along an axis parallel to the vertical direction V. When fluid, such as water, is directed through access port 56, at least a portion of the fluid may gather within collection basin 57. Air passing through exhaust passage 69 from the drying chamber 25 may pass over the gathered fluid within collection basin 57, evaporating the collected liquid and limiting the spread of liquid from fluid injector 134 within exhaust passage 69.

In additional or alternative embodiments, such as the exemplary embodiment of FIG. 5, a drain tube 59 is provided in fluid communication with exhaust passage 69. In such embodiments, drain tube 59 is open to exhaust passage 69 between inlet 54 and outlet 53 (See FIGS. 2 and 9), and downstream from fluid injector 134. Optionally, drain tube 59 may open to ducted conduit 68 directly below access port 56. In turn, both drain tube 59 and access port 56 will be positioned coaxially with each other, along an axis parallel to the vertical direction V. In optional embodiments, drain tube 59 extends from collection basin 57, draining away liquid gathered at collection basin 57. Drained liquid, such as water, may be evacuated to an ambient environment or returned to a water source (not pictured), e.g., a municipal water supply or a local water tank.

Figure 6:
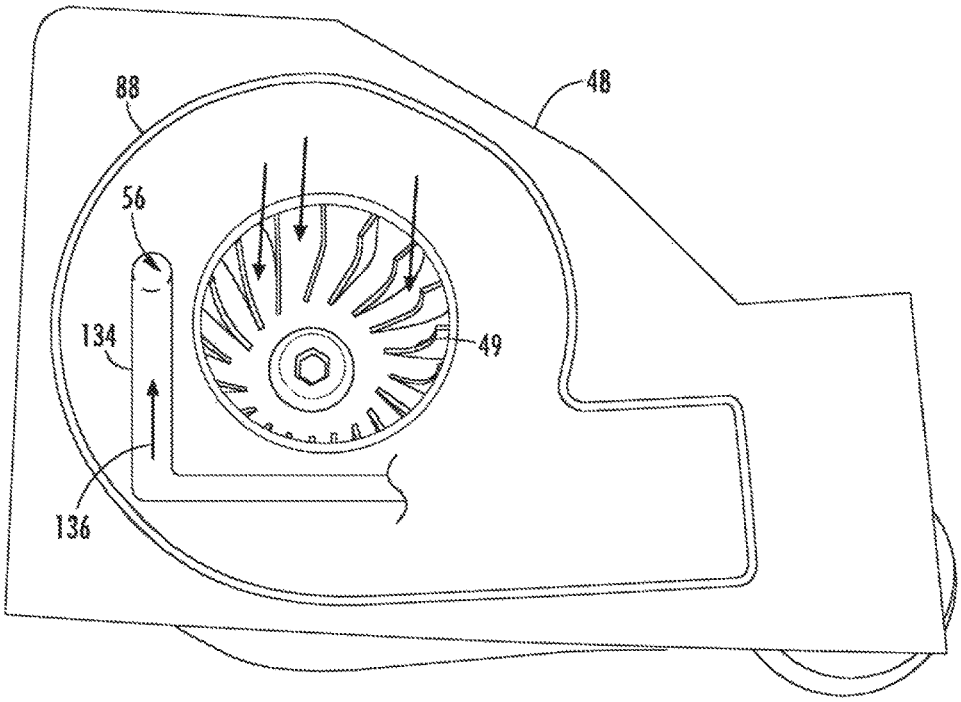
FIG. 6 provides a perspective view of a blower, including an impeller, according to an exemplary embodiment of the present disclosure.
Figure 7:
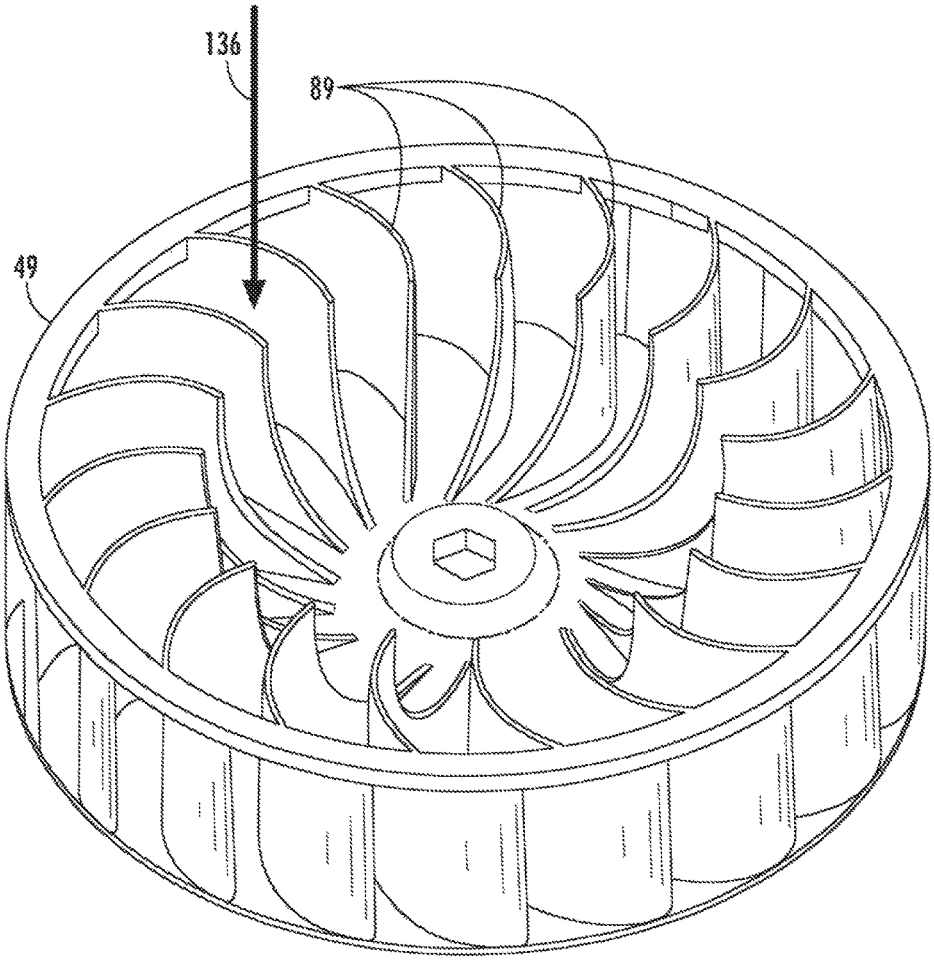
FIG. 7 provides a perspective view of the exemplary impeller of FIG. 6.

Turning to FIGS. 6 and 7, certain optional embodiments of appliance 10 include a fluid injector 134 attached to an air handler, such as blower 48. As mentioned above with reference to FIG. 2, blower 48 generally included a rotatable impeller 49 configured to draw air through exhaust passage 69 from drying chamber 25. In some embodiments, an outer housing 88 is disposed about impeller 49 to guide air to impeller 49. Optionally, at least one fluid injector 134 is fixed to outer housing 88. An access port 56 defined through outer housing 88 receives, and may hold, fluid injector 134 in a position wherein fluid injector 134 is directed at rotatable impeller 49. As described above, during operation of appliance 10 (see FIG. 2), a fluid flow 136 is selectively delivered from fluid injector 134 through access port 56. In exemplary embodiments such as those shown in FIGS. 6 and 7, though, fluid flow 136 is directed onto the rotating impeller blades 89. Upon receiving fluid flow 136, foreign materials such as lint may be forced or directed away from the impeller blades 89 and downstream through exhaust passage 69 (see FIG. 2). Moreover, a valve and/or secondary fan or pump may be provided upstream of fluid injector 134 to selectively release and/or force fluid flow 136 through fluid injector 134. Such a valve and/or secondary fan or pump may be in, e.g., electrical communication with controller 82 (see FIGS. 2 and 9) to receive an injection signal therefrom, as described above.

As also described above, fluid provided through fluid injector 134 may be provided as a suitable motivating medium. A suitable liquid (e.g., water) or gas (e.g., air) is provided in optional embodiments. As a result, fluid flow 136 in some embodiments is configured as a liquid flow or secondary airflow, respectively. In embodiments wherein a liquid flow is provided, fluid injector 134 may be configured in fluid communication with a water source (not pictured), e.g., a municipal water supply or a local water tank. In embodiments wherein a secondary airflow is provided, fluid injector 134 may be configured in fluid communication with an air source (not pictured), e.g., a pressurized air tank or an ambient environment.

Figure 8:
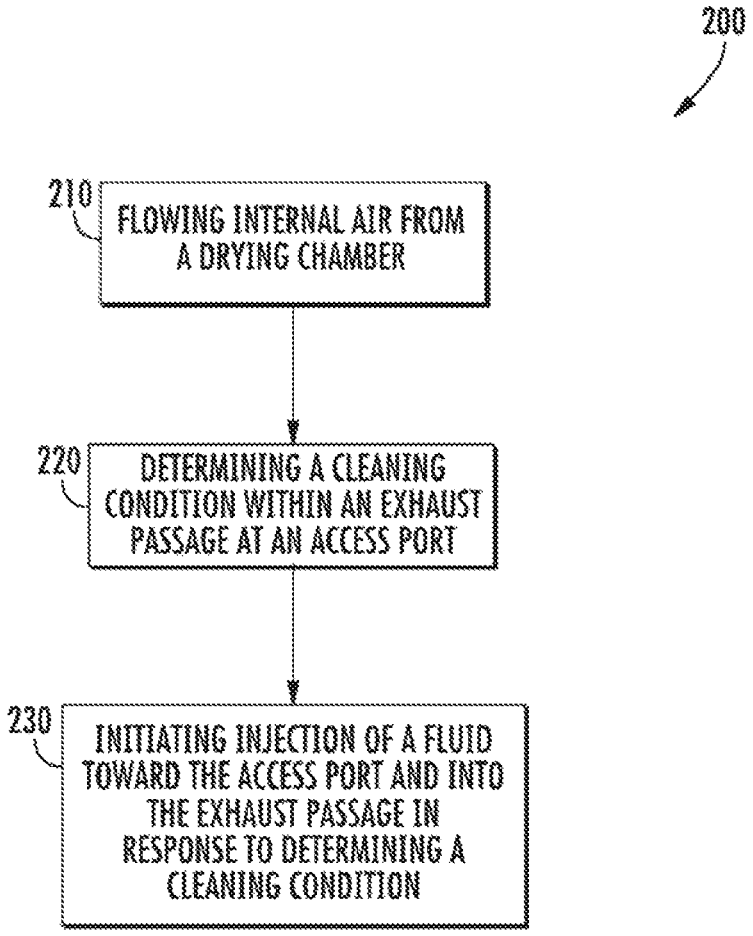
FIG. 8 provides a flow chart illustrating a method of cleaning an exhaust passage of an appliance exhaust in accordance with an exemplary embodiment of the present disclosure.

Turning now to FIG. 8, a flow diagram is provided of a method 200 according to an exemplary embodiment of the present disclosure. Generally, the method 200 provides for cleaning an exhaust passage 69 in a dryer appliance 10 that includes an exhaust passage 69, as described above. The method 200 can be performed, for instance, by the controller 82. For example, controller 82 may, as discussed, be in communication with exhaust sensor 100 and fluid injector 134, and may send signals to and receive signals from exhaust sensor 100 and fluid injector 134. Controller 82 may further be in communication with other suitable components of the appliance 10 to facilitate operation of the appliance 10 generally. FIG. 8 depicts steps performed in a particular order for purpose of illustration and discussion. Those of ordinary skill in the art, using the disclosures provided herein, will understand that the steps of any of the methods disclosed herein can be modified, adapted, rearranged, omitted, or expanded in various ways without deviating from the scope of the present disclosure.

Referring to FIG. 8, at 210, the method 200 includes flowing internal air from the drying chamber. An air handler, such as a blower, may be compelled to rotate a fan or impeller to motivate air through the exhaust passage defined by a conduit, as described above, wherein the conduit also defines an access port. In turn, an internal airflow is generated or facilitated by operation of a motor and/or fan, such as during a dry cycle.

At 220, the method 200 includes determining a cleaning condition within the exhaust passage at the access port. In exemplary embodiments, 220 includes detecting a dryer cycle of the dryer appliance. The dryer cycle may be, e.g., detected in response to the controller receiving a user input signal from a selector input. Optionally, 220 may include detecting multiple separate or repeated dryer cycles. Furthermore, 220 may include detecting an elapsed time period, e.g., passage of a predetermined time after a dryer cycle has been initiated or completed. In additional or alternative embodiments, 220 includes determining an abnormal sensor reading from the exhaust sensor. In some such embodiments, the controller may receive contemporary sensor reading indicative of current conditions being monitored at exhaust sensor. Determining an abnormal sensor reading may include comparing the contemporary sensor reading to an expected reading value or value range. As described above, the expected value or value range may be selected as a predetermined value, from a provided look-up table, and/or as a calculated value.

At 230, the method 200 includes selectively initiating injection of a fluid toward the access port and into the exhaust passage in response to determining a cleaning condition. In some embodiments, 230 includes directing fluid at the access port, as described above. In additional or alternative embodiments, 230 includes directing fluid through the access port. As a result, 230 may include flowing a secondary airflow into the exhaust passage or flowing a liquid flow into the exhaust passage. In embodiments wherein a liquid is released into the exhaust passage, the method 200 may further include collecting the released liquid within a collection basin. Additionally or alternatively, the released liquid may be drained through a drain tube in fluid communication with the exhaust passage.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:

a cabinet;

a drum mounted within the cabinet, the drum defining a drying chamber;

an outlet assembly attached to the drying chamber, the outlet assembly including a conduit defining an exhaust passage in fluid communication with the drying chamber, the conduit extending from an inlet at the drying chamber to an outlet, the conduit further defining an access port extending through an outer wall of the conduit at a position along the exhaust passage between the inlet and the outlet;

an exhaust sensor disposed in communication with the exhaust passage through the access port; and a fluid injector attached to the conduit between the inlet and the outlet, the fluid injector being directed at the access port and upstream therefrom to motivate a foreign material away from the access port and into the exhaust passage.

2. The dryer appliance of claim 1, further comprising an air source in fluid communication with the fluid injector to supply a secondary airflow through the fluid injector into the exhaust passage.

3. The dryer appliance of claim 1, further comprising a liquid source in fluid communication with the fluid injector to supply a liquid flow through the fluid injector into the exhaust passage.

4. The dryer appliance of claim 3, wherein the conduit further defines a collection basin, the collection basin being positioned below the fluid injector along a vertical direction.

5. The dryer appliance of claim 3, further comprising a drain tube in fluid communication with the exhaust passage between the inlet and the outlet and downstream from the fluid injector along a direction of flow of air through the exhaust passage.

6. The dryer appliance of claim 1, further comprising a controller operatively connected to the fluid injector, wherein the controller is configured to:

determine a cleaning condition within the exhaust passage, and selectively initiate injection of a fluid through the access port from the fluid injector when the cleaning condition is determined.

7. The dryer appliance of claim 6, wherein determining the cleaning condition comprises:

determining an abnormal reading from the exhaust sensor; and wherein injection is initiated in response to determination of the abnormal reading.

8. The dryer appliance of claim 6, wherein determining the cleaning condition comprises:

detecting a dryer cycle of the dryer appliance; and wherein injection is initiated of the fluid in response to detection of the dryer cycle.

9. A dryer appliance comprising:

a cabinet;

a drum mounted within the cabinet, the drum defining a drying chamber;

an outlet assembly attached to the drying chamber, the outlet assembly including a conduit defining an exhaust passage in fluid communication with the drying chamber, the conduit extending from an inlet at the drying chamber to an outlet;

an air handler attached to the conduit in fluid communication with the drying chamber, the air handler including a rotatable impeller operable to draw air through the exhaust passage and an outer housing disposed about impeller to guide air thereto; and a fluid injector attached to the air handler on the outer housing and directed at the rotatable impeller.

10. The dryer appliance of claim 9, further comprising a liquid source in fluid communication with the fluid injector to supply a liquid flow through the fluid injector onto the rotatable impeller.

11. The dryer appliance of claim 9, further comprising an air source in fluid communication with the fluid injector to supply a secondary airflow through the fluid injector onto the rotatable impeller.

12. A method of cleaning an exhaust passage in a dryer appliance, the dryer appliance including a drying chamber and an exhaust sensor in fluid communication with the exhaust passage, the exhaust passage being defined by a conduit extending from an inlet at the drying chamber to an outlet, the conduit further defining an access port extending through an outer wall of the conduit at a position along the exhaust passage between the inlet and the outlet, the exhaust sensor being in fluid communication with the exhaust passage through the access port, the method comprising:

flowing internal air from the drying chamber;

determining a cleaning condition within the exhaust passage at the access port; and selectively initiating injection of a fluid toward the access port through an outer wall of the conduit and into the exhaust passage in response to determining the cleaning condition.

13. The method of claim 12, wherein initiating injection of the fluid includes directing the fluid through the access port.

14. The method of claim 12, wherein directing the fluid flow includes flowing a secondary airflow into the exhaust passage.

15. The method of claim 12, wherein directing the fluid flow includes flowing a liquid flow into the exhaust passage.

16. The method of claim 15, further comprising collecting liquid in a collection basin defined within the exhaust passage.

17. The method of claim 15, further comprising draining liquid through a drain tube in fluid communication with the exhaust passage between the inlet and the outlet.

18. The method of claim 12, wherein determining the cleaning condition includes detecting a dryer cycle of the dryer appliance.

19. The method of claim 12, wherein determining the cleaning condition includes determining an abnormal sensor reading from the exhaust sensor.

20. The method of claim 19, wherein determining the abnormal sensor reading includes receiving a contemporary sensor reading from the sensor, and comparing the contemporary sensor reading to an expected sensor value.

* * * * *